US006880536B2

(12) United States Patent
Pratley et al.

(10) Patent No.: US 6,880,536 B2
(45) Date of Patent: Apr. 19, 2005

(54) LUBRICATION OPTIMIZATION OF SINGLE SPRING ISOLATOR

(75) Inventors: Mark H. Pratley, Marshall, MI (US); Daniel L. Thelen, Marshall, MI (US)

(73) Assignee: Eaton Corporation, Cleveland, OH (US)

( * ) Notice: Subject to any disclaimer, the term of this patent is extended or adjusted under 35 U.S.C. 154(b) by 110 days.

(21) Appl. No.: 10/619,297

(22) Filed: Jul. 14, 2003

(65) Prior Publication Data

US 2005/0011502 A1 Jan. 20, 2005

(51) Int. Cl.[7] ..... F02B 33/00; F01M 1/00

(52) U.S. Cl. ..... 123/559.1; 184/6.26; 184/6.16; 464/57; 464/66

(58) Field of Search ..... 123/559.1; 184/6.26, 184/6.16; 464/7, 55, 57, 63, 64, 66, 67, 68

(56) References Cited

U.S. PATENT DOCUMENTS

| | | | | | |
|---|---|---|---|---|---|
| 1,431,401 | A | * | 10/1922 | Hupp | 464/57 |
| 1,705,984 | A | * | 3/1929 | Lindsay | 464/57 |
| 2,115,819 | A | * | 5/1938 | Lewis | 464/66 |
| 2,963,006 | A | * | 12/1960 | Karde | 123/559.1 |
| 3,017,230 | A | * | 1/1962 | Meermans | 184/6.26 |
| 4,844,044 | A | * | 7/1989 | McGovern | 123/559.1 |
| 4,924,839 | A | * | 5/1990 | Mueller et al. | 123/559.1 |
| 4,944,279 | A | * | 7/1990 | Woodard | 123/559.1 |
| 4,953,517 | A | * | 9/1990 | McGovern et al. | 123/559.1 |
| 5,078,583 | A | | 1/1992 | Hampton et al. | 418/201.1 |
| 5,281,116 | A | * | 1/1994 | Gwin | 418/94 |
| 5,848,845 | A | * | 12/1998 | Jeng et al. | 184/6.26 |
| 5,893,355 | A | | 4/1999 | Glover et al. | 123/559.1 |
| 6,253,747 | B1 | | 7/2001 | Sell et al. | 123/559.1 |

* cited by examiner

*Primary Examiner*—Thai-Ba Trieu
(74) *Attorney, Agent, or Firm*—L. J. Kasper

(57) ABSTRACT

A rotary blower (26) includes a torsion damping mechanism for transmitting torque from an input drive (48) to a first timing gear (62), the mechanism including an input hub (52), an output hub (64), and a torsion spring (70) having an input end (72) and an output end (74). The housing (42) defines a chamber (44) containing fluid rotation of the timing gears resulting in an air-oil mist. The input hub and output hub define an axial gap (82) intermediate the input and output ends of the torsion spring. The output hub (64) defines an angled passage (86) having a radially outer end (84) in communication with the axial gap (82), and a radially inner end, whereby rotation generates a flow of the air-oil mist through the angled passage (86) and between the outer cylindrical surface of the hubs and the inside surface (76) of the torsion spring (70).

5 Claims, 3 Drawing Sheets

LUBRICATION OPTIMIZATION OF SINGLE SPRING ISOLATOR

BACKGROUND OF THE DISCLOSURE

The present invention relates to a rotary blower, and more particularly, to a torsion damping mechanism ("isolator") for reducing audible noise from the blower, and especially from the timing gears.

Although the present invention may be used advantageously on many different types of blowers, regardless of the manner of input drive to the blower, the present invention is especially adapted for use with a Roots-type rotary blower which is driven by an internal combustion engine, also referred to hereinafter as a "periodic" combustion engine because, in the typical internal combustion engine used commercially for on-highway vehicles, the torque output of the engine is not perfectly smooth and constant, but instead, is generated in response to a series of individual, discrete combustion cycles.

It should be understood by those skilled in the art that the present invention is not limited to a Roots-type blower, but could be used just as advantageously in a screw compressor type of device. However, the invention is especially advantageous in a Roots-type blower and will be described in connection therewith. A typical Roots-type blower transfers volumes of air from the inlet port to the outlet port, whereas a screw compressor actually achieves internal compression of the air before delivering it to the outlet port. However, for purposes of the present invention, what is most important is that the blower, or compressor, include a pair of rotors which must be timed in relationship to each other, and therefore, are driven by meshed timing gears. As Is now well known to those skilled in the blower art, the timing gears are potentially subject to conditions such as gear rattle and bounce.

Rotary blowers of the type to which the present invention relates (either Roots-type or screw compressor type) are also referred to as "superchargers" because they are used to effectively supercharge the intake side of the engine. Typically, the input to an engine supercharger is a pulley and belt drive arrangement which is configured and sized such that, at any given engine speed, the amount of air being transferred into the intake manifold is greater than the instantaneous displacement of the engine, thus increasing the air pressure within the intake manifold, and increasing the power density of the engine.

Rotary blowers of either the Roots-type or the screw compressor type are characterized by the potential to generate noise. For example, Roots-type blower noise may be classified as either of two types. The first is solid borne noise caused by rotation of timing gears and rotor shaft bearings subjected to fluctuating loads (the periodic firing pulses of the engine). The second type of noise is fluid borne noise caused by fluid flow characteristics, such as rapid changes in the velocity of the fluid (i.e., the air being transferred by the supercharger). The present invention is concerned primarily with the solid borne noise caused by the meshing of the timing gears. More particularly, the present invention is concerned with torsion damping mechanisms ("isolators") of the type which can minimize the "bounce" of the timing gears during times of relatively low speed operation, when the blower rotors are not "under load". The noise which may be produced by the meshed teeth of the timing gears during unloaded (non-supercharging), low-speed operation is also referred to as "gear rattle".

An example of a prior art torsion damping mechanism for a supercharger is illustrated and described in U.S. Pat. No. 6,253,747, assigned to the assignee of the present invention, and incorporated herein by reference. Such torsion damping mechanisms are also referred to as "isolators" because part of their function is to isolate the timing gears from the speed and torque fluctuations of the input to the supercharger. During the course of the development of a supercharger, including the torsion damping mechanism of the above-incorporated patent, one of the primary developmental concerns has been the durability of the torsion damping mechanism, and therefore, the ultimate service or durability life of the supercharger, in terms of the number of hours of operation, prior to any sort of supercharger component failure.

The torsion damping mechanism of the above-incorporated patent includes a pair of hub members (one attached to the input and the other attached to one of the timing gears), the hub members defining a cylindrical surface. A single torsion spring surrounds, and is closely spaced apart from, the cylindrical surface defined by the hub members. As is now known to those skilled in the art based primarily on the above-incorporated patent, the radial clearance between the cylindrical surface of the hub members and the inside diameter of the generally cylindrical torsion spring is selected to correspond to a predetermined positive travel limit (i.e., greater rotation of the input than of its associated timing gear).

When the torsion damping mechanism of the type to which the present invention relates achieves the predetermined positive travel limit, there is actual surface-to-surface engagement between the inside surface of the coils of the torsion spring and the adjacent cylindrical surfaces of the hub members. In connection with the development of a supercharger embodying the present invention, it has been observed that there has been a wear pattern on the inside surface of the coils of the torsion spring,and that there were iron oxides present on the wear surface of the spring. It has since been determined that the root cause of the wear pattern on the inside surface of the torsion spring is a phenomenon known as "fretting corrosion". Unfortunately, the configuration of the torsion damping mechanism is such that the torsion spring is "buried" within the mechanism, and any sort of access to the spring during operation is very limited.

Related to the observed fretting corrosion is the known fact that, if the cylindrical surfaces of the hub members wear or corrode to the extent of their diameters being reduced, the "diameter" of the inside surface of the torsion spring will be less than intended, at the positive travel limit of the isolator. Such a decrease in the diameter of the inside surface of the torsion spring will result in changes (an increase) in the level of the stress within the spring, thus typically reducing the life of the spring. A related problem has been observed at the point where one of the coils traverses the axial gap between the hub members, what has been observed is the cutting of a "slot" in the inside surface of the spring where it contacts hub on either side of axial gap. As is well known in the art, the formation of such a slot will result in a stress riser at that location in the spring, further limiting the fatigue life of the isolator spring.

BRIEF SUMMARY OF THE INVENTION

Accordingly, it is an object of the present invention to provide an improved torsion damping (isolator) mechanism for use on a rotary blower of the type described above, wherein the fatigue life of the mechanism may be substantially extended.

It is a more specific object of the present invention to provide an improved torsion damping mechanism which achieves the above-stated object by reducing the wear between the inside surface of the torsion spring and the adjacent surfaces of the input and output hub members.

It is another object of the present invention to provide an improved torsion damping mechanism which achieves the above-stated objects without the addition of any complex or costly structure or materials.

The above and other objects of the invention are accomplished by the provision of a rotary blower comprising a housing, first and second meshed, lobed rotors rotatably disposed in the housing for transferring relatively low pressure inlet port air to relatively high pressure outlet port air. First and second meshed timing gears are fixed relative to the first and second rotors, respectively, for preventing contact of the meshed lobes. An input drive is adapted to be rotatably driven by a positive torque, about an axis of rotation in one drive direction at speeds proportional to speeds of a periodic combustion engine. A torsion damping mechanism is included for transmitting engine torque from the input drive to the first timing gear, the torsion damping mechanism including a first member fixed to rotate with the input drive, a second member fixed to rotate with the first timing gear, and a helical torsion spring. The torsion spring has an input end fixed to rotate with the input drive and an output end fixed to rotate with the first timing gear, the torsion spring defining a normal inside diameter surrounding, and closely spaced apart from, an outer cylindrical surface defined by the first and second members.

The improved rotary blower is characterized by the housing defining a chamber containing a quantity of fluid whereby rotation of the first and second timing gears results in the generation of an air-oil mist within the chamber. The first and second members define therebetween an axial gap disposed axially intermediate the input end and the output end of the torsion spring. One of the first and second members defines an angle passage having a radially outer end in communication with the axial gap, and a radially inner end in communication with the axially opposite end of the member. As a result, rotation of the members generates a flow of the air-oil mist through the angled passage and the axial gap and between the outer cylindrical surface of the members and the inside diameter of the torsion spring.

DETAILED DESCRIPTION OF THE PREFERRED EMBODIMENT

Figure 1:
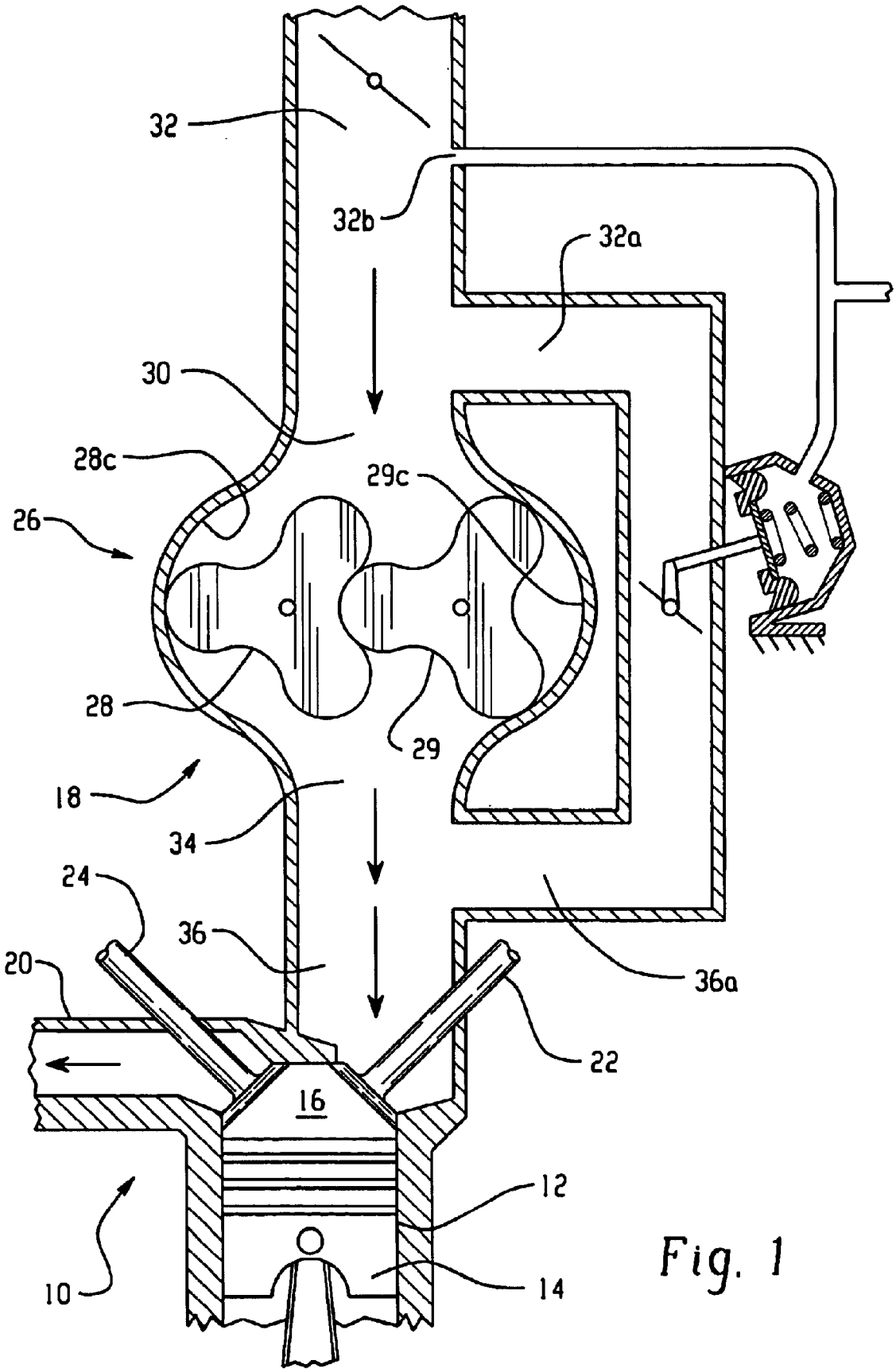
FIG. 1 is a schematic illustration of an intake manifold assembly having a positive displacement blower or supercharger therein for boosting intake pressure to an internal combustion engine.

Referring now to the drawings, which are not intended to limit the invention, FIG. 1 is a schematic illustration of an intake manifold assembly, including a Roots blower type of supercharger of the type which is now well known to those skilled in the art. An engine, generally designated 10, includes a plurality of cylinders 12, and a reciprocating piston 14 is disposed within each cylinder, thereby defining an expandable combustion chamber 16. The engine 10 includes intake and exhaust manifold assemblies 18 and 20, respectively, for directing combustion air to and from the expandable combustion chamber 16, by way of intake and exhaust poppet valves 22 and 24, respectively.

The intake manifold assembly 18 includes a positive displacement rotary blower 26 of the Roots ("back-flow") type, as is illustrated and described in U.S. Pat. Nos. 5,078,583 and 5,893,355, assigned to the assignee of the present invention and incorporated herein by reference. The blower 26 includes a pair of rotors 28 and 29, each of which includes a plurality of meshed lobes. The rotors 28 and 29 are disposed in a pair of parallel, transversely overlapping cylindrical chambers 28*c* and 29*c*, respectively. The rotors may be driven mechanically by engine crankshaft torque transmitted thereto in a known manner, such as by means of a drive belt (not illustrated herein). The mechanical drive rotates the blower rotors 28 and 29 at a fixed ratio, relative to crankshaft speed, such that the blower displacement is greater than the engine displacement, thereby boosting or supercharging the air flowing into the combustion chambers 16, in a manner now well known in the art. The supercharger or blower 26 includes an inlet port 30 which receives air or air-fuel mixture from an inlet duct or passage 32, and further includes a discharge or outlet port 34, directing the charge air to the intake valves 22 by means of a discharge duct 36. The inlet duct 32 and the discharge duct 36 are interconnected by means of a bypass passage, as is now well known to those skilled in the art, which is not especially relevant to the present invention, and therefore, will not be described further herein.

Figure 2:
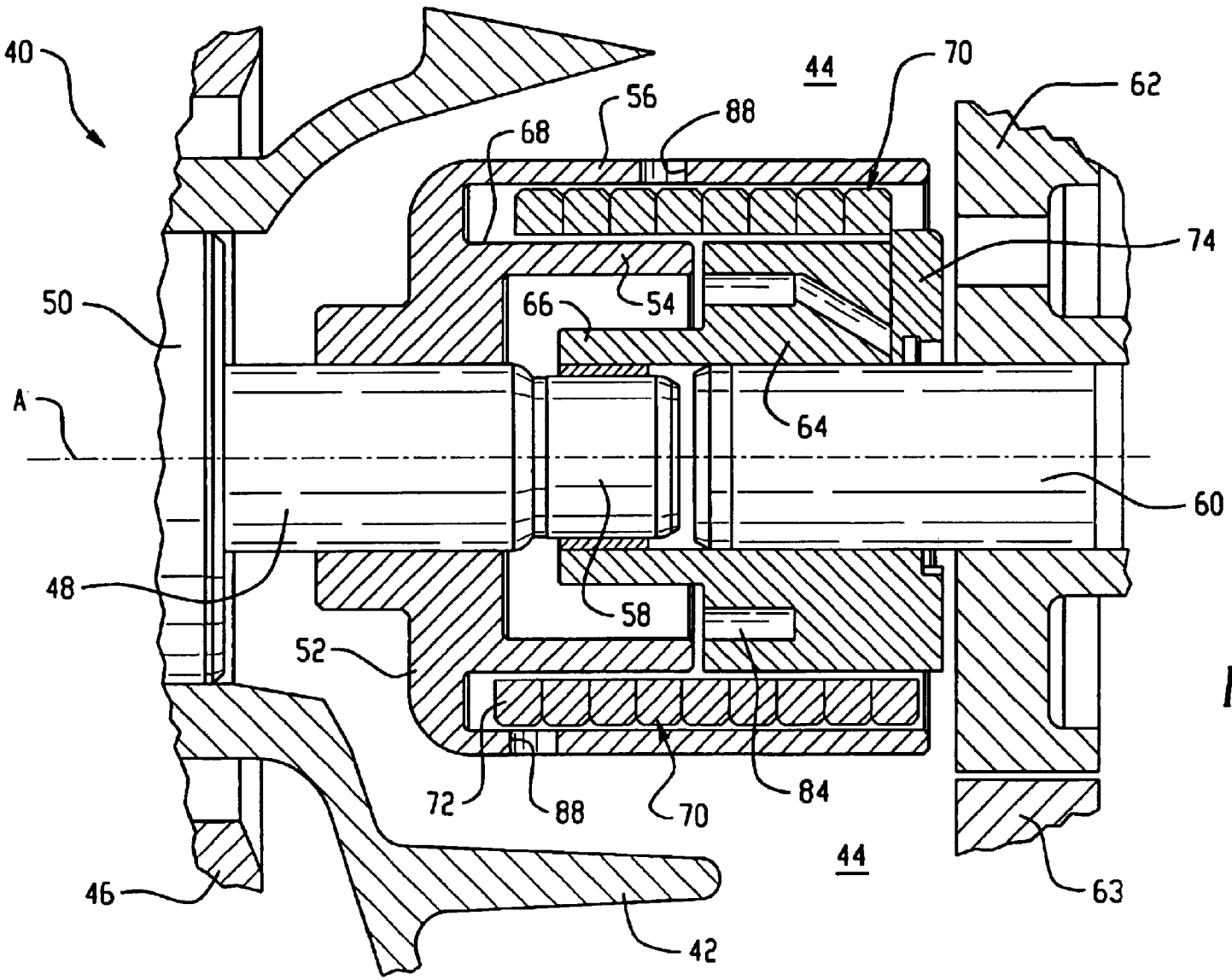
FIG. 2 is an enlarged, fragmentary, axial cross-section of the input section of the supercharger shown schematically in FIG. 1.

Referring now primarily to FIG. 2, there is illustrated an input section, generally designated 40, of the blower 26. The input section 40 includes a housing member 42, which would typically be bolted to the main blower housing (see FIG. 1), i.e., the housing which defines the cylindrical chambers 28*c* and 29*c*. The housing member 42 defines therein a chamber 44, which would typically contain a quantity of lubrication fluid, as will be described in greater detail subsequently, one function of the lubrication fluid being to lubricate the timing gears.

Surrounding the housing member 42, and shown only fragmentarily in FIG. 2 is an input pulley 46, by means of which input drive is transmitted to the blower 26 through an input shaft 48. Preferably, the input shaft 48 is rotatably supported within a forward end of the housing member 42 by means of a suitable bearing set 50, shown only in fragmentary, external view in FIG. 2. Attached to rotate with the input shaft 48 is an input hub member 52. The input hub member 52 includes a radially inner, generally cylindrical hub portion 54, and a radially outer cylindrical enclosure portion 56, as will be described in greater detail subsequently.

At the rearward end (right end in FIG. 2) of the input shaft 48 is a reduced diameter shaft portion 58, and disposed immediately adjacent the shaft portion 58 is the forward end of a rotor shaft 60. The input shaft 48 and the rotor shaft 60 cooperate to define an axis of rotation A, and the rotor 28 rotates about this axis of rotation A. In the subject embodiment, but by way of example only, it is the rotor shaft 60 on which the rotor 28 is mounted. Also mounted on the rotor shaft 60 is a timing gear 62 which, as is well known to those skilled in the art, is in toothed engagement with a second timing gear 63, which is mounted on a second rotor shaft (not shown herein). Also mounted on the second rotor shaft would be the rotor 29 shown in FIG. 1.

Disposed on the forward end (left end in FIG. 2) of the rotor shaft 60 is an output hub member 64, which preferably includes a reduced diameter pilot portion 66 surrounding, and being piloted on, the shaft portion 58, thus maintaining alignment and concentricity of the hub members 52 and 64. In the subject embodiment, and by way of example only, there is a journal bearing member disposed between the shaft portion 58 and the pilot portion 66.

Figure 3:
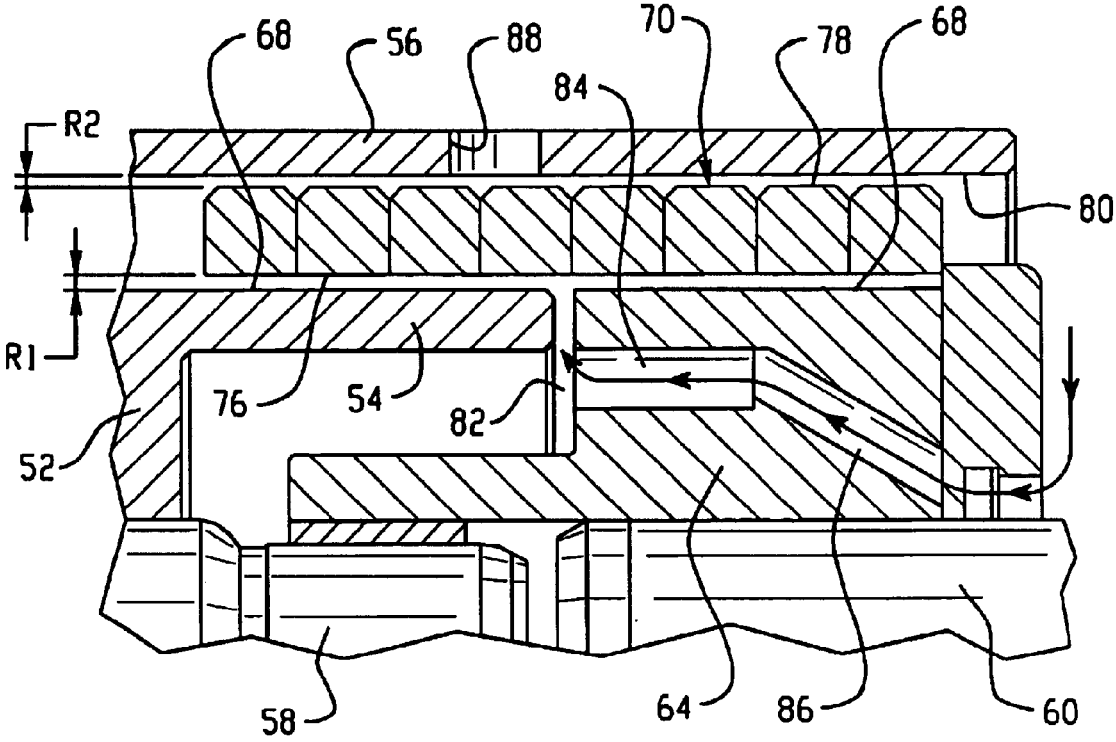
FIG. 3 is a further enlarged, fragmentary, axial cross-section similar to FIG. 2, illustrating the operation of the present invention.

Referring still primarily to FIG. 2, but now also in conjunction with FIG. 3, it may be seen that the radially inner hub portion 54 and the output hub member 64 cooperate to define an outer cylindrical surface 68. It should be understood that a single cylindrical surface (the surface 68) is recited herein as being defined by the inner pub portion 54 and the hub member 64 because, preferably, the hub portion 54 and the output hub member 64 would define substantially identical outside diameters, for reasons which would be apparent from a reading and understanding of the above-incorporated U.S. Pat. No. 6,253,747. Surrounding the cylindrical surface 68 is a single, helical torsion spring 70 which is preferably of the general type illustrated and described in greater detail in the above-incorporated patent. The torsion spring 70 preferably includes an input end (shown at "72" in FIG. 2) which would typically include an axially-oriented tang (not shown herein) fixed to rotate with the input hub member 52. In a similar fashion and as is shown in both FIGS. 2 and 3, the torsion spring 70 includes an output end, illustrated as a radially-oriented tang 74 which is fixed relative to the output hub member 64. Those skilled in the art will understand that all that is essential to the invention is that the input end of the spring 70 is fixed to rotate with the "input", and the output end of the spring is fixed to rotate with the "output" (the timing gear 62).

Referring now to both FIGS. 2 and 3, the helical torsion spring 70 preferably comprises spring wire having a generally square or rectangular cross-section, as may be seen in the drawings, such that the coils of the torsion spring 70, in their normal, relaxed state as shown in FIGS. 2 and 3, define a normal inside diameter, designated 76 in FIG. 3. The inside diameter 76 surrounds, and is closely spaced apart from the outer cylindrical surface 68, the radial gap therebetween being designated "R1" in FIG. 3. As was explained in the above-incorporated patent, the radial gap R1 is representative of a "travel limit" in the positive direction of rotation of the input shaft 48.

In a similar manner, the torsion spring 70 defines a normal outside diameter 78 and the outer enclosure portion 56 defines an inner cylindrical surface 80, the radial gap between the outside diameter 78 and the inner cylindrical surface 80 comprising a radial gap "R2" in FIG. 3. As is also described in the above-incorporated patent, the radial gap R2 is representative of a travel limit in the negative direction of rotation of the input shaft 48.

As was mentioned in the BACKGROUND OF THE DISCLOSURE, one of the problems encountered in the development of the present invention was the actual surface-to-surface engagement between the inside surface (inside diameter 76) of the torsion spring 70 and the adjacent outer cylindrical surface 68 of the inner hub portion 54 and output hub member 64. Typically, such engagement occurs as a result of a fluctuation in the speed and/or torque transmitted to the timing gear 62 by the input pulley 46. When such fluctuations occur, the inside surface (diameter 76) of the torsion spring 70 becomes wrapped tightly about the outer cylindrical surface 68 of the inner hub portion 54 and output hub member 64, as the input hub member 52 "overruns" the output hub member 64. Such engagement can, over time result in the fretting corrosion and wear described previously.

Referring now primarily to FIG. 3, the present invention will be described. The input hub member 52 and output hub member 64 are configured to define therebetween an axial gap 82 which, preferably, extends about the entire circumferential extent of the hub members 52 and 64, for reasons which will become apparent subsequently. The output hub member 64 defines an annular chamber 84 disposed to open into the axial gap 82, although it should be understood that the annular chamber 84 is not essential to the present invention, but is beneficial in the subject embodiment (i.e., the particular design shown in FIG. 3). Finally, the output hub member 64 defines one or more angled passages 86. In accordance with one important aspect of the invention, each of the angled passages 86 has its radially outermost end opening into the annular chamber 84, and therefore, being in open communication with the axial gap 82. Also, each of the angled passages 86 has its radially inner end opening at the rearward surface of the output hub member 64, for reasons which will be described subsequently.

When the blower 26 is operating, and the timing gears 62 and 63 are rotating, the level of the lubricating oil in the chamber 44 is maintained just high enough that at least one of the timing gears (62 or 63) will rotate through the lubrication oil. As is well known to those skilled in the art, even at engine idle, the timing gears on a supercharger are normally rotating at several thousand rpm and therefore, the result of the timing gear rotating through the lubrication oil will be the generation of an air-oil splash or mist moving about within the chamber 44. For simplicity of reference, the term "mist" will be used hereinafter, and in the appended claims, to mean and include whatever form (splash, vapor, mist, etc.) is taken by the combination of the air and the oil within the chamber 42.

Figure 4:
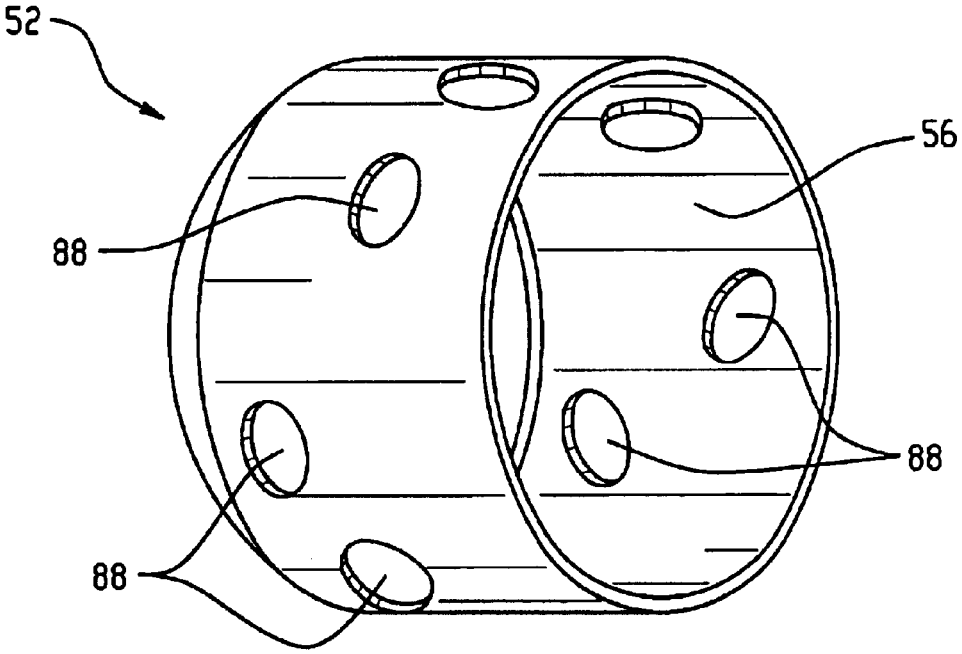
FIG. 4 is a perspective view, on a scale somewhat smaller than FIG. 2, of the input hub member, illustrating one aspect of the present invention.

Referring now to FIG. 4, in conjunction with FIG. 3, it may be seen that the outer enclosure portion 56 of the input hub member 52 preferably defines a plurality of openings 88 which, as is best shown in FIG. 4, may be disposed at various axial locations along the axial length of the enclosure portion 56. When the entire torsion damping (isolator) mechanism rotates, even at engine idle, the result will be the generation of a flow of the air-oil mist following the path indicated by the arrows in FIG. 3. Therefore, the air-oil mist will enter the radially inner, rearward end of the angled passages 86 and flow forwardly and radially outward, under the influence of centrifugal force, flowing into and through the annular chamber 84, into the axial gap 82. Although, in FIGS. 2 and 3, the adjacent coils of the spring 70 are shown as being in contact, those skilled in the spring art understand that there are axial spaces between the adjacent coils. Thus, as the isolator mechanism rotates, there is a continuous, radially outward flow, under the influence of the centrifugal force caused by the angle of the passages 86.

All that is essential to the present invention is that the axial gap 82 be disposed somewhere intermediate the input end 72 and the output end 74 of the torsion spring 70. However, as is shown in FIG. 3, it is preferred that the axial gap 82 be somewhere near the middle of the torsion spring 70 because the air-oil mist flows forwardly out of the annular chamber 84, then radially outwardly through the axial gap 82 and into the radial gap R1 between the outer cylindrical surface 68 and the inside diameter 76 of the torsion spring 70.

Preferably, the flow of the air-oil mist will, after leaving the axial gap 82, divide into a portion flowing rearwardly, and a portion flowing forwardly. The result of these flows is that the outer surface 68 of the hub members and the inside diameter 76 of the torsion spring 70 will be continuously lubricated by the oil carried within the mist. Thus, it may be seen that the purpose of the openings 88 in the outer enclosure portion 56 is to help induce the radially outward flow, but in addition, by having one or more of the openings 88 disposed toward the forward end (right end in FIG. 2) of the enclosure portion 56, it is more likely that a substantial portion of the air-oil mist will be induced to flow in the forward direction.

It should be apparent to those skilled in the art from a reading and understanding of this specification that having the passages 86 disposed at an angle, and angled outwardly in the direction of flow, is an essential feature of the invention. Without the angle on the passages 86, the mist within the chamber 44 would not be drawn radially inward (as shown by the arrow in FIG. 3) and then pumped radially outward into the gap between the outer surface 68 and the inside surface (diameter 76) of the torsion spring 70. In the subject embodiment, and by way of example only, there are four of the angled passages 86, evenly spaced, circumferentially about the output hub member 64.

Although, in the subject embodiment, it is the output hub member 64 which defines the angled passages 86 feeding the air-oil mist into the axial gap 82, those skilled in the art will understand that the angled passages could have been provided in the input hub member 52. In such case, the radially inner end of the angled passages 86 would be disposed at the forward end of the hub member 52, while the radially outer end of the angled passages 86 would be in communication with the axial gap 82. However, it is considered preferable to have the output hub member 64 define the angled passages 86 because, in that embodiment, the "upstream" end (radially inner end) of the angled passages 86 is disposed immediately adjacent the timing gear (62 or 63) which is generating the air-oil mist.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A rotary blower comprising a housing, first and second meshed, lobed rotors rotatably disposed in the housing for transferring relatively low pressure inlet port air to relatively high pressure outlet port air; first and second meshed timing gears fixed relative to said first and second rotors, respectively, for preventing contact of said meshed lobes; an input drive adapted to be rotatably driven by a positive torque, about an axis of rotation in one drive direction at speeds proportional to speeds of a periodic combustion engine; and a torsion damping mechanism for transmitting engine torque from said input drive to said first timing gear, said torsion damping mechanism including a first member fixed to rotate with said input drive, a second member fixed to rotate with said first timing gear, and a helical torsion spring having an input end fixed to rotate with said input drive and an output end fixed to rotate with said first timing gear, said torsion spring defining a normal inside diameter surrounding, and closely spaced apart from, an outer cylindrical surface defined by said first and second members; characterized by:

(a) said housing defining a chamber containing a quantity of fluid whereby rotation of said first and second) timing gears results in the generation of an air-oil mist within said chamber;

(b) said first and second members defining therebetween an axial gap disposed axially intermediate said input end and said output end of said torsion spring; and (c) one of said first and second members defining an angled passage having a radially outer end in communication with said axial gap, and a radially inner end in communication with the axially opposite end of said member, whereby rotation of said first and second members generates a flow of said air-oil mist through said angled passage and said axial gap and between said outer cylindrical surface of said first and second members and said inside diameter of said torsion spring.

2. A rotary blower as claimed in claim 1, characterized by said input drive comprises an input pulley fixed to rotate with an input shaft, said first member being fixed to rotate with said input shaft.

3. A rotary blower as claimed in claim 2, characterized by said first member comprises an input hub member fixed to rotate with said input shaft, and said second member comprises an output hub member fixed to rotate with a timing gear shaft, said first timing gear being fixed to rotate with said timing gear shaft.

4. A rotary blower as claimed in claim 3, characterized by said input hub member including a generally cylindrical portion surrounding, and closely spaced apart from, an outer cylindrical surface defined by said torsion spring, said generally cylindrical portion defining a plurality of openings to facilitate said flow of said air-oil mist.

5. A rotary blower as claimed in claim 1, characterized by said helical torsion spring comprises coils having a generally square or rectangular cross section.

* * * * *